US011220384B2

(12) United States Patent
Unruh

(10) Patent No.: US 11,220,384 B2
(45) Date of Patent: Jan. 11, 2022

(54) INSULATING PRODUCT MODULE AND PROCESS FOR MANUFACTURING SUCH A MODULE

(71) Applicant: SAINT-GOBAIN ISOVER, Courbevoie (FR)

(72) Inventor: Andreas Unruh, Neustadt (DE)

(73) Assignee: SAINT-GOBAIN ISOVER, Courbevoie (FR)

( * ) Notice: Subject to any disclaimer, the term of this patent is extended or adjusted under 35 U.S.C. 154(b) by 161 days.

(21) Appl. No.: 16/324,717

(22) PCT Filed: Aug. 29, 2017

(86) PCT No.: PCT/FR2017/052296
§ 371 (c)(1),
(2) Date: Feb. 11, 2019

(87) PCT Pub. No.: WO2018/042118
PCT Pub. Date: Mar. 8, 2018

(65) Prior Publication Data

US 2019/0177065 A1 Jun. 13, 2019

(30) Foreign Application Priority Data

Aug. 30, 2016 (FR) ..... 16 58050

(51) Int. Cl.
*B65D 71/00* (2006.01)
*B65B 11/58* (2006.01)
(Continued)

(52) U.S. Cl.
CPC ..... *B65D 71/0096* (2013.01); *B65B 11/025* (2013.01); *B65B 11/58* (2013.01);
(Continued)

(58) Field of Classification Search
CPC .... B65D 71/00; B65D 71/0096; B65D 85/00; B65D 85/07; B65B 11/00; B65B 11/58; B65B 11/585; B65B 2220/16–20
See application file for complete search history.

(56) References Cited

U.S. PATENT DOCUMENTS 3,460,671 A * 8/1969 Harm ..... B65D 71/08 206/391
4,886,167 A * 12/1989 Dearwester ..... B65D 75/00 206/389

(Continued)

FOREIGN PATENT DOCUMENTS

DE 10 2013 208 136 A1 11/2014
EP 1 777 170 A1 4/2007
WO WO 2004/103821 A1 12/2004

OTHER PUBLICATIONS

International Search Report dated Oct. 18, 2017 in PCT/FR2017/052296 filed Aug. 29, 2017.

*Primary Examiner* — Chelsea E Stinson
(74) *Attorney, Agent, or Firm* — Oblon, McClelland, Maier & Neustadt, L.L.P.

(57) ABSTRACT

A module includes compressible insulation products that each have a longitudinal axis, a peripheral surface, and first and second ends. The module includes a single row of insulation products positioned next to one another along a first direction perpendicular to the longitudinal axes of the insulation products, a first film that wraps each insulation product of the single row in a compressed state by covering the peripheral surface of the insulation product, a second film that wraps the single row of insulation products by covering some of the peripheral surface of the insulation products of the row, and a third film that wraps the single row of insulation products by covering the first and second ends of each insulation product of the row.

16 Claims, 5 Drawing Sheets

(51) Int. Cl.
*B65D 85/07* (2017.01)
*B65B 63/02* (2006.01)
*B65B 11/02* (2006.01)

(52) U.S. Cl.
CPC ..... *B65B 11/585* (2013.01); *B65B 63/02* (2013.01); *B65D 85/07* (2018.01); *B65B 2220/16* (2013.01); *B65D 2571/00012* (2013.01); *B65D 2571/00018* (2013.01)

(56) References Cited

U.S. PATENT DOCUMENTS

| | | | | |
|---|---|---|---|---|
| 7,311,199 | B2 * | 12/2007 | Vantilt | B65D 75/38 206/321 |
| 2006/0196799 | A1 | 9/2006 | Vantilt | |
| 2013/0067861 | A1 * | 3/2013 | Turner | B65D 75/006 53/428 |
| 2019/0202614 | A1 * | 7/2019 | Unruh | B65D 71/0096 |

* cited by examiner

INSULATING PRODUCT MODULE AND PROCESS FOR MANUFACTURING SUCH A MODULE

The present invention relates to the packaging of compressible insulation products, in particular with a view to the transport thereof or the storage thereof. More specifically, the invention relates to a module comprising compressible insulation products that are, in unit form, in the form of rolls or of substantially parallel batches of boards. The invention also relates to a process for manufacturing such a module, and to a palletized assembly comprising such modules.

Fibrous insulation products, such as felts made of glass wool or other mineral wool, are low-density products that occupy a large volume. In order to facilitate the transport thereof and the storage thereof, it is desirable to limit the bulkiness of these products and to produce palletizable loads. For this purpose, the insulation products in unit form are conventionally packaged in a compressed state, by being covered with a protective wrapper generally made of kraft paper or plastic, the insulation products then being assembled in the form of rows and then positioned on pallets.

One constraint for the packaging is that the deformations generated during a compression of the insulation product must not degrade its ability to recover its thickness upon being unwrapped, the insulating qualities of the product being dependent on this thickness recovery. The compression must be adapted so that the deformations that it generates develop uniformly within the insulation product, in order to prevent a deterioration thereof. Added to this constraint is the need to protect the insulation product with respect to the external environment, in particular when it comprises a binder that is sensitive to the effects of moisture. However, the protective wrapper that makes it possible to keep the product in the form of a roll, or to assemble a series of boards as one batch, does not generally cover the whole of the outer surface of the product and is therefore not sufficient to ensure complete protection against moisture.

EP 0 220 980 A1 describes a package in which a module is formed by juxtaposing several insulation products in a row, and encircling the row using a film maintains the insulation products in compression against one another. Several modules are then superimposed on a pallet and everything is assembled by stretch-wrapping. One drawback of this type of package is that, due to the compression exerted by the encircling film, the modules have a diabolo shape that is not optimal for palletization. Moreover, even though the insulation products are protected by the stretch-wrapping film, they are however no longer protected, in particular at their ends, once the palletized assembly has been opened or damaged. There is then a risk of infiltration of water into the insulation product, which may lead to a degradation of its insulating properties.

Furthermore, WO 2004/103821 A1 describes a pack of rolls made of a compressible fibrous material, in which several rolls are arranged next to one another with the axes thereof parallel, in several superimposed rows. In this pack, a film wraps each row of several rolls in a compressed state of the rolls, and a sleeve wraps several rows of superimposed rolls in a compressed state of the rows against one another. In particular, the sleeve covers at least one portion of the peripheral surface of the rolls of an upper row and of a lower row of said superimposed rows of the pack. Such an arrangement does not make it possible to guarantee an optimal protection of the insulation products, in particular with respect to moisture, since it is difficult to obtain a uniform and continuous wrapping due in particular to the differences in lengths or offsets between the rows.

It is these drawbacks that the invention intends, more particularly, to solve by proposing a module of compressible insulation products, the dimensions of which are stable and reproducible, enabling a compact stacking of several modules, in which an improved protection of the insulation products is ensured and the quality of the insulation products is preserved, in particular in terms of thickness recovery.

For this purpose, one subject of the invention is a module comprising compressible insulation products, each insulation product having a longitudinal axis, a peripheral surface and first and second ends, the module comprising:

- a single row of insulation products positioned next to one another, successively along a first direction perpendicular to the longitudinal axes of the insulation products, the insulation products of the row having their longitudinal axes parallel to one another,
- a first film which wraps each insulation product of the single row in a compressed state of the insulation product, by covering the peripheral surface of the insulation product,
- a second film which wraps the single row of insulation products, by covering some of the peripheral surface of the insulation products of the row, characterized in that the module further comprises a third film which wraps the single row of insulation products by covering the first and second ends of each insulation product of the row, so that the single row of insulation products is completely covered by the combination of the films.

Within the context of the invention, the insulation products may be rolls. As a variant, the insulation products may be batches of several boards that have been preassembled, for example by means of a heat-shrinkable film, these batches having a substantially parallelepipedal shape and having a similar bulkiness to that of the rolls. In what follows, reference is often made to rolls, it being understood that the invention is not limited to this particular case.

Of course, the fact that the module comprises a single row (that is to say only one row) of insulation products, which is wrapped both by the second film that covers some of the peripheral surface of the insulation products of the single row and by the third film that covers the first and second ends of each insulation product of the single row, means that the second and third films are directly facing the faces of the single row, without insertion of another row of insulation products located on either side of the single row along a direction perpendicular to the longitudinal axes of the insulation products and to the first direction of the single row.

By means of the invention, for each module, the single row of insulation products is completely covered by the combination of the first, second and third films, so that the insulation products of the module are protected from moisture or other contaminants. It is thus possible to produce palletized assemblies of rolls or of boards very simply, by superimposing several modules in accordance with the invention, while guaranteeing that the insulation products in each module are protected, in particular from moisture, even in the event of opening or damaging the outer protection of the palletized assembly, which may be a stretch-wrapping film or a stretchable or shrinkable cover. This is particularly advantageous when the insulation products comprise a binder that is sensitive to moisture, such as a bio-based binder, in particular based on saccharides, sugars and/or sugar alcohols. Such palletized assemblies may be stored outside, without further precautions, without risk of deterioration of the quality of the insulation products and in particular without any thickness recovery problems. Advantageously, it is possible to subdivide the palletized loads obtained according to the invention into a series of modules, which is practical, in particular during unpacking operations.

For a module according to the invention, the wrapping with the second and third films is carried out for a single row of insulation products, which has several advantages compared to the case where each row is wrapped with a second film-then a stack of several rows is wrapped with a third film as in WO 2004/103821 A1. Firstly, this double wrapping of each row improves the protection of the insulation products in particular with respect to moisture since the installation of a third film overlapping with a second film is easier around a single row rather than around a stack of several rows. Specifically, a stack of rows may comprise rows that are not aligned, for example due to differences in lengths or offsets between the rows, which does not make it possible to have a join between the films that is as continuous as in the case of a single row. Furthermore, in the event of damaging a third film for example in a palletized assembly, the number of insulation products impacted is lower in the case where each row is wrapped with the third film compared to the case where a stack of several rows is wrapped with the third film. Similarly, owing to the double wrapping of each row, it is possible to unpack only a portion of a palletised assembly and to leave the remaining modules in storage, since for each module the row of insulation products is protected individually from moisture, and not a whole stack of rows.

It is noted that, within the meaning of the invention, the term "to wrap" does not mean that there is coverage of the whole of the element that is wrapped. Thus, for example, the first film may cover the peripheral surface of the insulation product, without covering the ends of the insulation product. Similarly, the third film may cover the first and second ends of each insulation product of the row, without covering the whole of the faces of the row, which are perpendicular to the ends of the insulation products. Furthermore, the second film may cover only a central portion of the peripheral surface of the insulation products of the row, without extending from one end to the other of the insulation products.

According to one feature of the invention, the second film and the third film form, around the single row of insulation products, two sleeves having axes that are perpendicular to one another. More specifically, the second film forms a sleeve, the central axis of which extends along the direction of the longitudinal axes of the insulation products, whereas the third film forms a sleeve, the central axis of which extends along the first direction.

The row of insulation products comprises two end faces formed by the ends of the insulation products, and also two main faces and two transverse faces which are perpendicular to the ends of the insulation products. The second film wraps the single row of insulation products by extending over the main faces and the transverse faces of the row, without necessarily completely covering the main faces and the transverse faces of the row, while the third film wraps the single row of insulation products by extending over the end faces and over the main faces of the row, here too without necessarily completely covering the main faces of the row.

In one embodiment of the invention, the single row of insulation products is completely covered by the combination of the second film and the third film. Such an arrangement where a single row is enclosed within a package formed by the combination of the second film in the third film makes it possible to limit the joining zones between films and further improve the protection of the insulation products of the module.

Advantageously, the third film at least partially covers the second film, or vice versa. This makes it possible to limit the presence of openings or interstices at the interface between the films of the module, which are liable to form points of entry of water inside the module.

According to one feature of the invention, the second film wraps the single row of insulation products in a compressed state of the insulation products against one another along the first direction. This compression along the first direction supplements the compression of each insulation product provided by the first film and makes it possible to limit the bulkiness of the module.

According to another feature of the invention, the third film wraps the single row of insulation products in a compressed state of the insulation products along a second direction perpendicular to the longitudinal axes of the insulation products and to the first direction. Preferably, this compression along the second direction supplements the compression of the insulation products against one another along the first direction provided by the second film.

The compressing of the insulation products in two perpendicular directions of the module makes it possible to achieve a maximum compactness of the module, which corresponds in particular to a substantially parallelepipedal shape of the row of insulation products. Owing to this substantially parallelepipedal shape, the second film and the third film of the module extend along substantially flat surfaces, hence a more continuous overlap between films which guarantees high protection, in particular against infiltration of water inside the module. Furthermore, the double compression makes it possible to distribute the compression stresses, which limits the risk of deterioration of the insulation products.

According to one advantageous aspect of the invention, in the module, each insulation product has a square cross section with rounded corners. Such a square cross section with rounded corners results from the compressing of the insulation products along the first direction and along the second direction of the module which are perpendicular to one another. Very advantageously, in this configuration, the module has a substantially parallelepipedal shape which is highly favorable for palletization. Furthermore, for an insulation product having a square cross section with rounded corners, the deformations generated in the product are distributed uniformly within the product. This makes it possible to preserve the ability of the insulation product to recover its thickness upon being unwrapped, and therefore its insulating properties. Here too, the wrapping of a single row of insulation products with the second and third films makes it possible to best control the distribution of the deformations generated in the insulation product, by controlling, row by row, the compression applied along the first direction and along the second direction, which is not possible in the case of wrapping each row with a second film then wrapping a stack of several rows with a third film as described in WO 2004/103821 A1.

According to one feature of the invention, the second film and the third film are not joined together. As a variant, the second film and the third film may be joined together, for example by adhesive bonding or by welding.

Within the context of the invention, the single row of the module advantageously comprises a number of insulation products of between 2 and 10.

According to one advantageous aspect, at least one among the first film, the second film and the third film is a plastic film that has relatively weak extension properties. In particular, at least one among the first film, second film and the third film preferably has a strength at 10% elongation of greater than 15 MPa, preferably of greater than 17 MPa or 20 MPa, in the extrusion direction and in the direction transverse to the extrusion direction. The strength may be measured according to the standard ISO 527/3, on standardized film test specimens. According to this standard, the elongation of the film is measured for an increasing tensile force applied to the film (measured in MPa) and a standardized speed. The compression of each insulation product and the compression of each row of insulation products may thus be obtained and maintained, respectively, by a single first film and by single second and third films. Preferably, the first film, the second film and the third film are made of high-density polyethylene (HDPE).

Another subject of the invention is a stack of modules comprising at least two modules as described above, which are superimposed along a second direction perpendicular to the longitudinal axes of the insulation products and to the first direction of each module.

Another subject of the invention is a palletized assembly comprising a pallet, at least two stacks of modules as described above, which are superimposed on one another and on the pallet with the longitudinal axes of the insulation products perpendicular to the pallet, and means for holding the stacks on the pallet.

In one embodiment, the means for holding the stacks on the pallet comprise an outer cover. According to one preferred variant, the outer cover is a stretchable cover, formed by stretching, at the periphery of the stacks, a sheath of stretchable plastic film, for example a sheath made of low-density polyethylene (LDPE). According to one less preferred variant, the outer cover is a shrinkable cover, formed by shrinking, at the periphery of the stacks, a sheath of heat-shrinkable plastic film, for example a sheath made of heat-shrinkable polyethylene.

In another embodiment, the means for holding the stacks on the pallet comprise a stretch-wrapped film at the periphery of the stacks, for example a polyethylene film with a thickness of 20 to 30 microns having a mechanical stretchability of greater than 200%, in particular of the order of 250%. Conventionally, a top sheet is also provided on the top of the load formed by the stacks, for example made of a relatively thick polyethylene film, having a thickness of at least 75 microns.

Another subject of the invention is a process for manufacturing a module having a single row of compressible insulation products, each insulation product having a longitudinal axis, a peripheral surface and first and second ends, the process comprising steps wherein:

- each insulation product is wrapped using a first film which covers the peripheral surface of the insulation product and which maintains the insulation product in a compressed state;
- a single row of insulation products of the module is formed by positioning several insulation products provided with the first film next to one another, successively along a first direction perpendicular to the longitudinal axes of the insulation products, the insulation products of the row having their longitudinal axes parallel to one another;
- the single row of insulation products is wrapped using a second film, which covers some of the peripheral surface of the insulation products of the row and which holds the insulation products of the row next to one another along the first direction;
- the single row of insulation products is wrapped using a third film, which covers the first and second ends of each insulation product of the row.

Another subject of the invention is a process for manufacturing a palletized assembly comprising modules each having a single row of compressible insulation products, each insulation product having a longitudinal axis, a peripheral surface and first and second ends, the process comprising steps wherein:

- each insulation product is wrapped using a first film which covers the peripheral surface of the insulation product and which maintains the insulation product in a compressed state;
- the single row of insulation products of each module is formed by positioning several insulation products provided with the first film next to one another, successively along a first direction perpendicular to the longitudinal axes of the insulation products, the insulation products of the row having their longitudinal axes parallel to one another;
- each module having a single row of insulation products is formed, on the one hand, by wrapping the single row of insulation products using a second film, which covers some of the peripheral surface of the insulation products of the row and which holds the insulation products of the row next to one another along the first direction and, on the other hand, by wrapping the single row of insulation products using a third film, which covers the first and second ends of each insulation product of the row;
- a stack of modules is formed by superimposing at least two modules having a single row of insulation products along a direction perpendicular to the longitudinal axes of the insulation products and to the first direction of each module;
- at least two stacks are superimposed on one another and on a pallet with the longitudinal axes of the insulation products perpendicular to the pallet;
- the stacks and the pallet are assembled using means for holding the stacks on the pallet.

Within the context of a process according to the invention, the single row of insulation products of each module may be formed in a stacker. Furthermore, the wrapping of the single row of insulation products using the second and third films may be carried out by two successive encircling operations so as to form two sleeves having axes perpendicular to one another, with the second film that forms a sleeve, a central axis of which extends along the direction of the longitudinal axes of the insulation products, while the third film forms a sleeve, a central axis of which extends along the first direction. For each encircling operation of the single row of insulation products, respectively using the second film and using the third film, the encircling device advantageously comprises means for the relative displacement of a band of film around the row of insulation products.

According to a first variant, the single row of insulation products of the module is wrapped using the second film before the row is wrapped using the third film. According to a second variant, the single row of insulation products of the module is wrapped using the third film before the row is wrapped using the second film.

In one embodiment of the invention, the stacks and the pallet are assembled using an outer cover obtained by stretching or shrinking a sheath of plastic film, the sheath being deployed around the stacks and the pallet along a direction parallel to the longitudinal axes of the insulation products.

In another embodiment of the invention, the stacks and the pallet are assembled by stretch wrapping, using a stretch-wrapping film which is deployed around the stacks and the pallet along a stretch-wrapping direction parallel to the longitudinal axes of the insulation products.

The features and advantages of the invention will become apparent in the following description of embodiments of a module of insulation products and of a palletized assembly in accordance with the invention, given solely by way of example and with reference to the appended drawings, in which.

Figure 1:
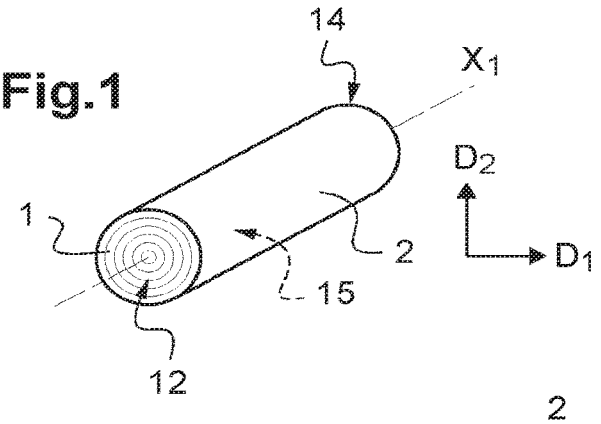
FIGS. 1 to 4 are schematic perspective views showing successive steps of a process for manufacturing a module of rolls in accordance with the invention.

Schematically illustrated in FIG. 1 is a roll 1, formed by rolling up a strip of insulation made of compressible fibrous material, such as glass wool or rock wool. This roll has a longitudinal axis $X_1$, a peripheral surface 15 and two ends 12 and 14. Conventionally, during the rolling up of the roll 1, the fibrous material undergoes a compression, with a compression ratio suitable for ensuring both that the bulkiness of the strip of insulation is minimized in the rolled-up state and that the strip of insulation regains its thickness and its insulating characteristics in the rolled out state. The roll 1 has also been wrapped with a first film 2 that maintains the roll in a compressed state, by covering the peripheral surface 15 of the roll. By way of example, the roll 1 has a diameter at its ends 12, 14 of the order of 300 to 600 mm, and each roll has a length parallel to the axis $X_1$ of the order of 800 to 1250 mm.

Figure 2:
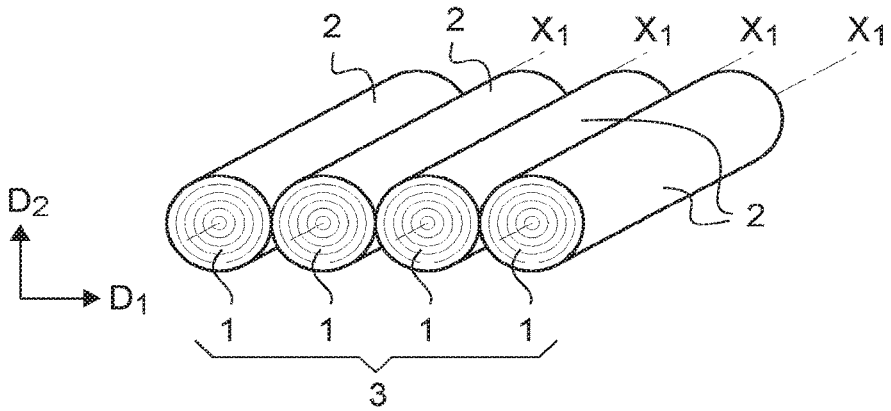

As shown in FIG. 2, a row 3 of rolls is formed by positioning several rolls 1 next to one another, successively along a first direction $D_1$ perpendicular to the longitudinal axes $X_1$ of the rolls, with their axes parallel to one another. By way of example, the row 3 has a length along the first direction $D_1$ of the order of 900 to 3000 mm, which corresponds to a row of three to six rolls depending on the diameter of the rolls. In the example represented, each row 3 comprises four juxtaposed rolls 1 and has a length along the first direction $D_1$ of the order of 1600 mm.

Figure 3:
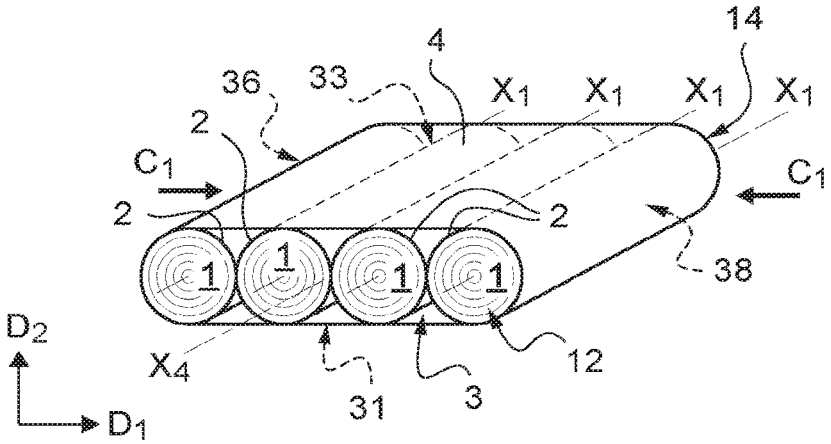
Figure 4:
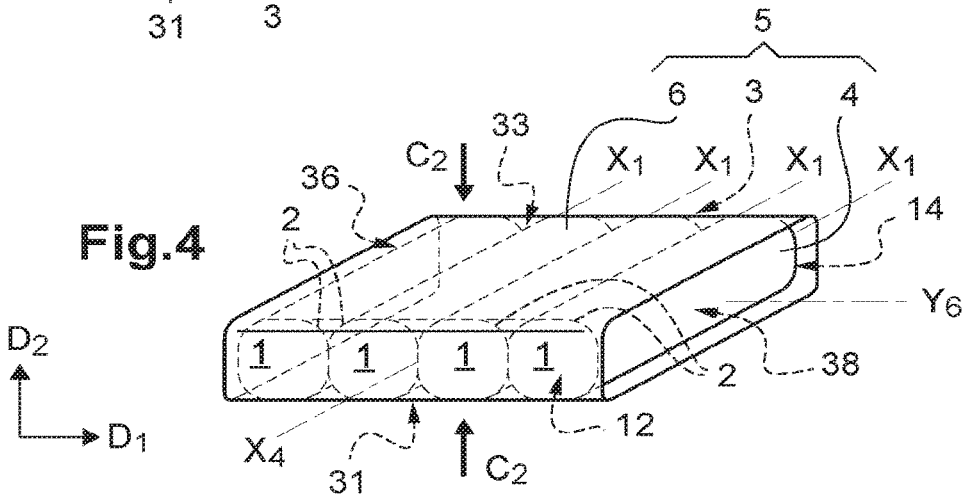

In order to form a module 5 having a single row 3 of rolls 1, the single row 3 is wrapped with a second film 4 and with a third film 6, with application of a compression of the rolls of the row, respectively a compression along the first direction $D_1$ which is maintained by the wrapping with the second film 4, as shown by the arrows $C_1$ of FIG. 3, and a compression along a second direction $D_2$ which is maintained by the wrapping with the third film 6, where the second direction $D_2$ is perpendicular to the longitudinal axes $X_1$ of the rolls and to the first direction $D_1$, as shown by the arrows $C_2$ of FIG. 4. The order of the wrappings of the single row 3 with the second film 4 and with the third film 6 is not important. In particular, in the example represented in FIGS. 3 and 4, the row 3 is wrapped using the second film 4 before being wrapped using the third film 6, but the reverse would also be possible within the context of the invention.

The single row 3 of the module 5 may be wrapped with the second 4 and with the third film 6 by two successive encircling operations so as to form two sleeves having axes perpendicular to one another, with the second film 4 that forms a sleeve, a central axis $X_4$ of which extends along the direction of the longitudinal axes $X_1$ of the rolls, while the third film 6 forms a sleeve, a central axis $Y_6$ of which extends along the first direction $D_1$.

The wrapping with the second film 4 may be carried out in an encircling device, for example in which the film 4 is deployed around the single row 3 along the first direction $D_1$, by relative displacement of a band of film 4 and of the row 3 while applying the compression $C_1$ along the first direction $D_1$. Advantageously, the second film 4 extends from one end to the other of the rolls 1, covering the main faces 31, 33 and transverse faces 36, 38 of the row 3 and leaving the ends 12 and 14 of each roll free. The compression applied along the direction of the arrows $C_1$ is for example of the order of 1.5 tonnes. As seen in FIG. 3, following such a compression, the rolls 1 have a cross section of oval shape, the largest axis of which is along the second direction $D_2$.

Similarly, the wrapping with the third film 6 may be carried out in an encircling device, for example in which the film 6 is deployed around the single row 3 along the direction of the longitudinal axes $X_1$ of the rolls 1, by relative displacement of a band of film 6 and of the row 3 while applying the compression $C_2$ along the second direction $D_2$. The third film 6 covers the ends 12 and 14 of each roll of the row 3 and the main faces 31, 33 of the row 3, leaving the transverse faces 36, 38 of the row 3 free. Preferably, the compression applied along the direction of the arrows $C_2$ is lower than the compression applied along the direction of the arrows $C_1$. As seen in FIG. 4, following the compression $C_2$ carried out along the second direction $D_2$ perpendicular to the direction of the compression $C_1$, the rolls 1 each have a square cross section with rounded corners.

The module 5 thus obtained by encircling the single row 3 with the films 4 and 6 has a substantially parallelepipedal shape, which is highly favorable for palletization. Furthermore, owing to this substantially parallelepipedal shape seen in FIG. 4, the second film 4 and the third film 6 extend along substantially flat surfaces, hence a more continuous overlap between the films 4 and 6 which guarantees high protection, in particular against infiltration of water inside the module 5. By way of example, the module 5 has a length parallel to the axes $X_1$ of the rolls of the order of 800 to 1250 mm, a length along the first direction $D_1$ of the order of 1100 to 1250 mm, and a height along the second direction $D_2$ of the order of 360 to 400 mm.

Preferably, the first film 2, the second film 4 and the third film 6 are each formed of a strip of plastic which is not very extensible, for example a strip of high-density polyethylene (HDPE), so that each film 2, 4, 6 maintains the rolls 1 of the module 5 in their compressed state.

Using modules 5 having a single row 3 of rolls 1 in accordance with the invention as described above, it is possible to produce palletized assemblies in a simple manner. Two examples of palletized assemblies are illustrated in the first and second embodiments represented in FIGS. 5 to 8.

In these two embodiments, stacks 8 are formed, which are intended to be positioned on a palette 13. Each stack 8 is obtained by superimposing several modules 5 along the second direction $D_2$ of the modules. In the examples represented, each stack 8 comprises three modules 5 superimposed along the second direction $D_2$. By way of example, each stack 8 has a length parallel to the axes $X_1$ of the rolls of the order of 800 to 1250 mm, a length along the first direction $D_1$ of the order of 1100 to 1250 mm, and a length along the second direction $D_2$ of the order of 1100 to 1200 mm. Thus, it is possible to fit two pallets with dimensions of 1200 to 1250 mm by 1200 to 1250 mm, supporting superimposed stacks 8, side-by-side in a truck having a width of the order of 2400 to 2500 mm. Of course, the dimensions of the rolls 1, the number of rolls 1 and the degrees of compression $C_1$ and $C_2$ may be adapted so that the dimensions of the stacks 8 correspond to any conventional dimensions of pallets and of means of transport.

Figure 5:
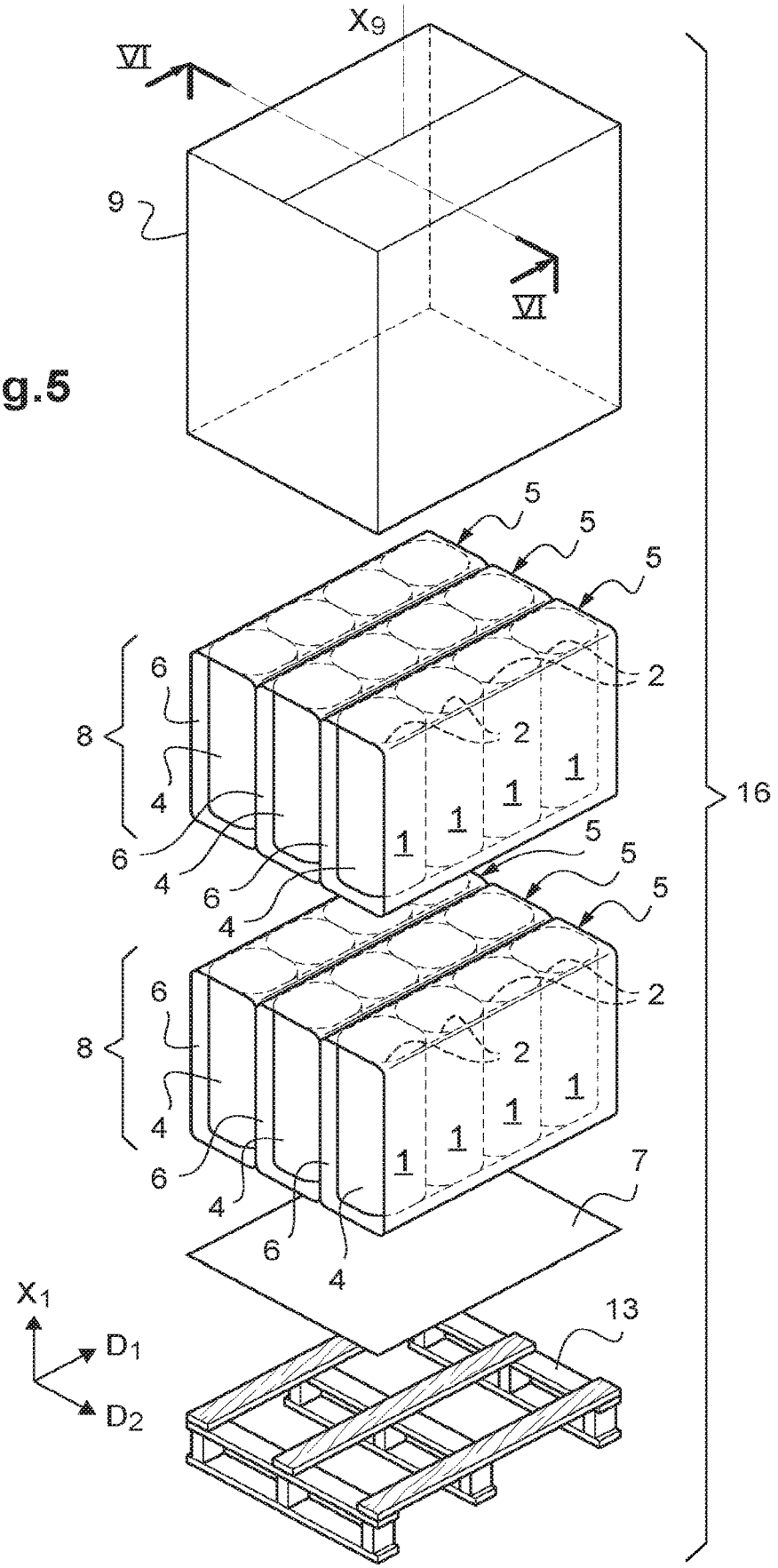
FIG. 5 is a schematic exploded perspective view of a first embodiment of a palletized assembly comprising modules according to the invention.
Figure 6:
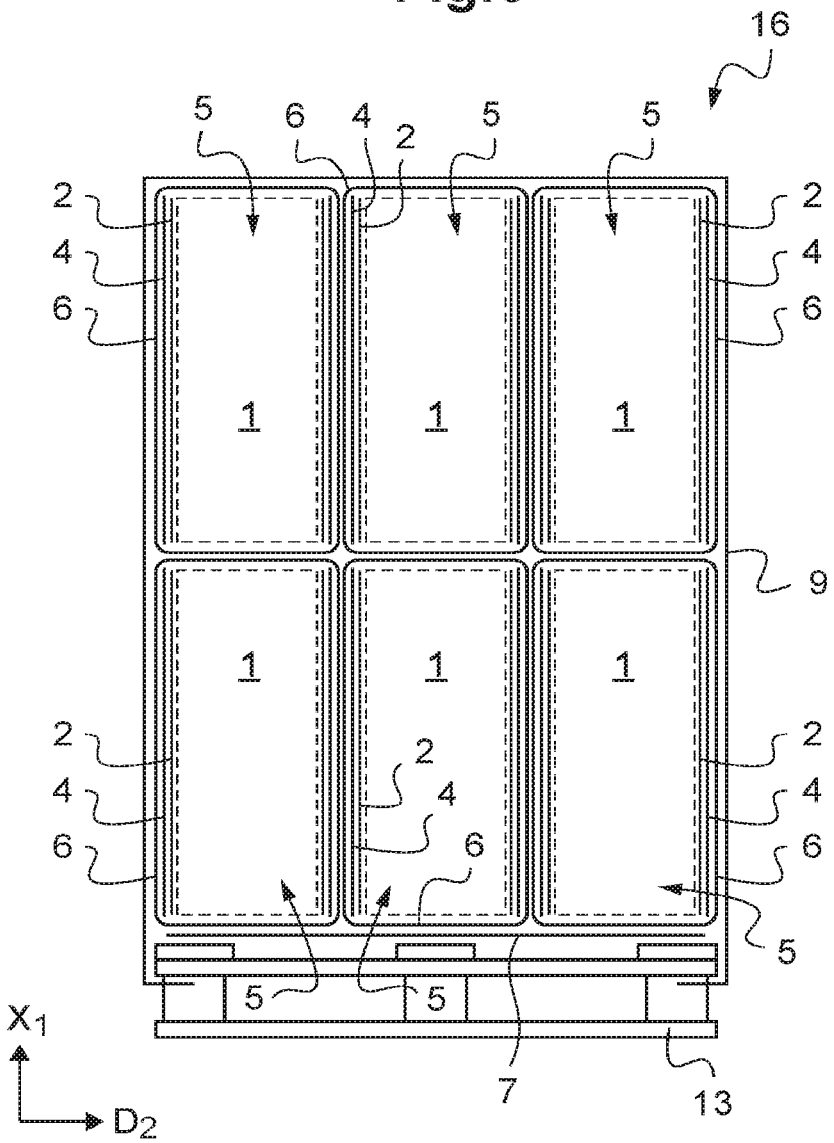
FIG. 6 is a schematic cross section along the plane VI from FIG. 5.

In the first embodiment represented in FIGS. 5 and 6, the palletized assembly 16 comprises a pallet 13 and two stacks 8. The pallet 13 is preferably formed of two wooden plates or duckboards spaced apart by spacers that define a sufficient space for the introduction of the forks of a handling appliance. Advantageously, the lower plate of the pallet 13 enables an easy displacement on a track and a stacking of loads. A microperforated base 7 formed by a plastic film, for example a 50-micron polyethylene film that is uniformly perforated for discharging water of condensation may optionally be fastened to the base of the pallet 13. The two stacks 8 are superimposed on one another and on the pallet 13 in a configuration where the rolls 1 are "upright" on the pallet 13, that is to say with their longitudinal axes $X_1$ perpendicular to the pallet.

For holding the stacks 8 on the pallet 13, the palletized assembly 16 comprises an outer cover 9, which is preferably a stretchable cover, formed by stretching a sheath of plastic film at the periphery of the stacks 8. The installation of the outer cover 9 around the stacks 8 and the pallet 13 is carried out, in a known manner, in a stretchable cover packaging device. In FIGS. 5 and 6, the vertical direction of the packaging device corresponds to the direction of the main axis $X_9$ of the outer cover 9. In this example, the outer cover 9 is deployed around the stacks 8 and the pallet 13 along a direction parallel to the longitudinal axes $X_1$ of the rolls.

Conventionally, in the packaging device, the sheath of stretchable plastic film is stored around a spool, by being pleated in a bellows or accordion tube shape. The packaging device comprises a welding station configured in order to weld the sheath, forming a welded joint. After welding, the sheath is cut transversely in a cutting station in order to produce a cover 9 independent of the spool and sealed in its upper portion.

The pleated outer cover 9 is then stretched in a horizontal plane parallel to the welding zone of the upper portion of the outer cover 9, which is the plane perpendicular to the longitudinal axes $X_1$ of the rolls, while being positioned above the load. The outer cover 9 is then opened out, and deposited on and around the stacks 8 and the pallet 13 following a vertical displacement from top to bottom along a direction parallel to the longitudinal axes $X_1$ of the rolls. At the end of the covering operation, the lower end of the outer cover 9 is folded under the pallet 13. The tightening of the outer cover 9 is carried out by elasticity, which firmly holds the outer cover 9 around the load. The outer cover 9 protects the palletized assembly 16 from adverse weather conditions.

Figure 7:
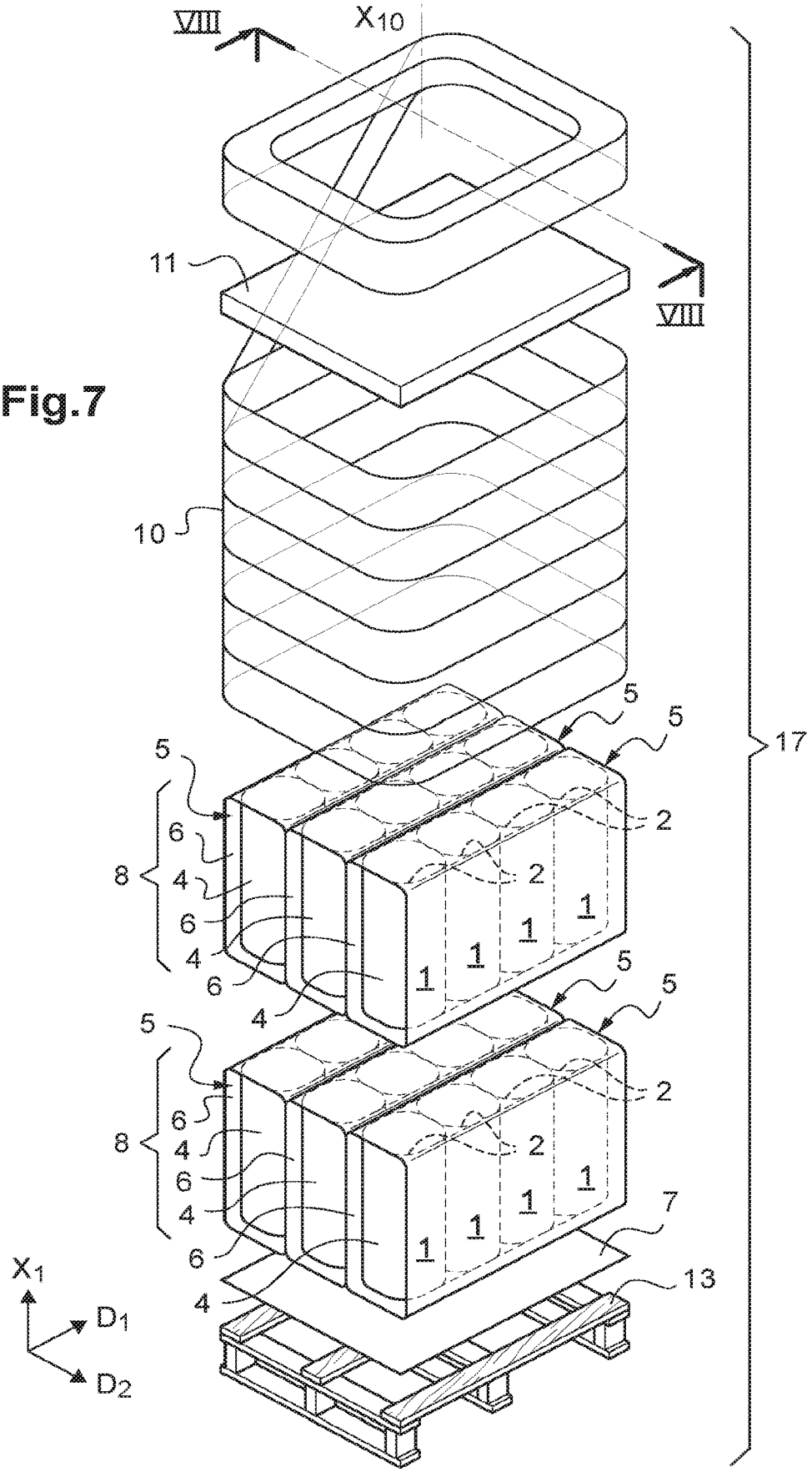
FIG. 7 is a view similar to FIG. 5 for a second embodiment of a palletized assembly comprising modules according to the invention.
Figure 8:
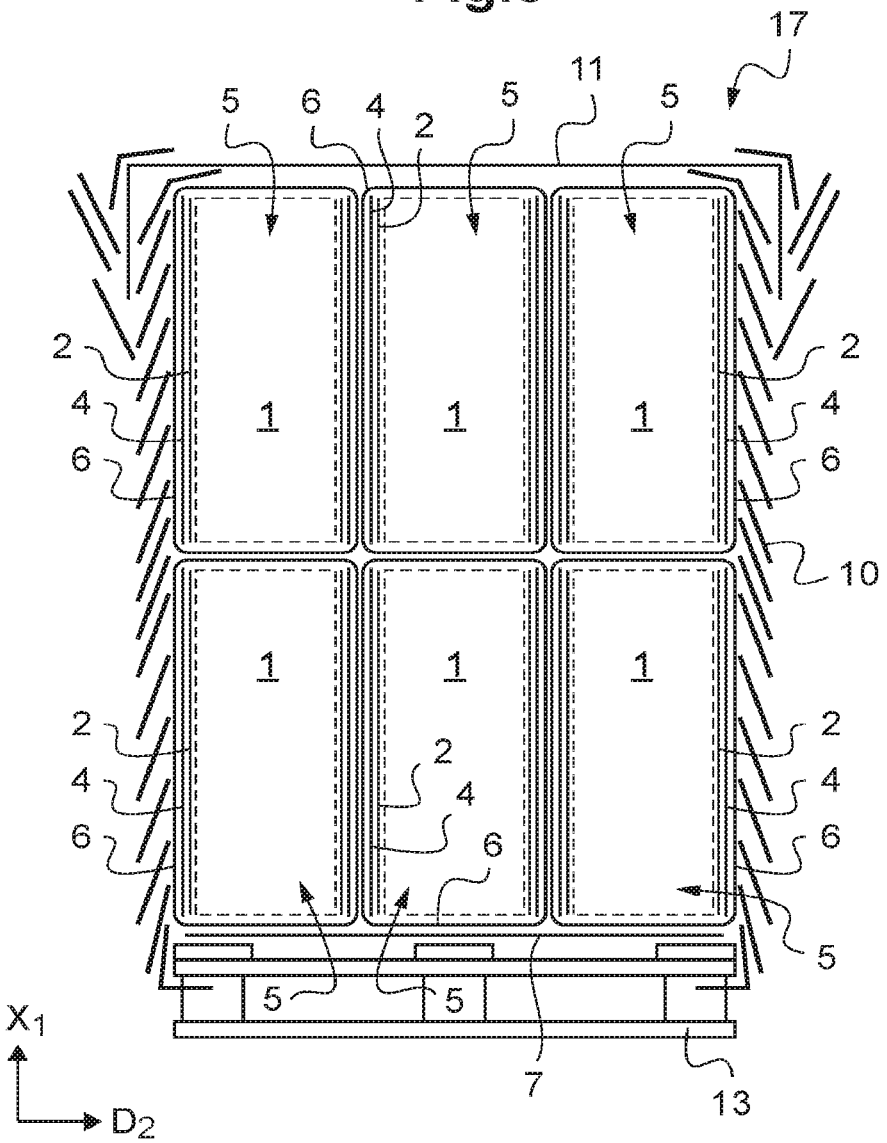
FIG. 8 is a schematic cross section along the plane VIII from FIG. 7.

In the second embodiment of a palletized assembly represented in FIGS. 7 and 8, the elements similar to those of the first embodiment bear identical references. The palletized assembly 17 in accordance with the second embodiment differs from the first embodiment in that the stacks 8 are not held on the pallet 13 using an outer cover 9, but by stretch wrapping using a film 10 which is deployed around the stacks 8 and the pallet 13 with a displacement along a direction parallel to the longitudinal axes $X_1$ of the rolls.

The installation of the stretch-wrapping film 10 around the stacks 8 and the pallet 13 is in particular carried out, in a known manner, in a stretch-wrapping device. In FIGS. 7 and 8, the vertical direction of the stretch-wrapping device corresponds to the direction of the central axis $X_{10}$ of the stretch wrapping. The stretch-wrapping device may be, for example, a rotating ring machine, comprising a system of unwinding and stretching the film 10 and a system of installing a top sheet 11 on the top of the load. By way of example, the stretch-wrapping film 10 may be a polyethylene film with a thickness of 20 to 30 microns having a stretchability of 250%, and the top sheet 11 may be based on a relatively thick polyethylene film, having a thickness of at least 75 microns.

The stretch-wrapping operations take place in a manner suitable to protect the palletized assembly 17 from adverse weather conditions. For this purpose, the outermost layer of the stretch-wrapping film 10 is deployed from bottom to top, so that the layer positioned highest is always overlapping from the top, seen from the outside, with an arrangement similar to roof tiles, as represented schematically in FIG. 8. Such an arrangement prevents water from entering inside the palletized assembly 17. As is known, the numbers of turns and the percentages of overlap during the stretch wrapping are adjusted on a case-by-case basis.

For example, a stretch wrapping cycle is carried out in the following manner: when the assembly comprising the stacks 8 positioned on the pallet 13 is in place in the stretch-wrapping device, a stabilizer plate is lowered to lock the load formed by the stacks 8, and the stretch wrapping starts from the bottom, with a few turns that trap the pallet 13. Starting from the bottom, the ring is gradually moved up, a stop being made at the junction between the two stacks 8 of the load. On approaching the top of the load, the stabilizer plate is withdrawn, which is possible since the load is self-stabilized by the film 10 already in place. A length of top sheet film 11 is then unwound, to the desired length on top of the load, the plate is lowered and the top sheet is cut. The stretch wrapping is then restarted downward over several turns, so that the top sheet 11 is encircled by several turns of the stretch-wrapping film 10, which is finally welded to itself and cut. In order to ensure protection against adverse weather conditions, any overlap between the turns of the film 10 that are stretch-wrapped downward around the top sheet 11 is avoided as much as possible.

The invention is not limited to the examples described and represented. In particular, the values given in the examples above for the dimensions of the rolls and stacks are purely illustrative, it being understood that the dimensions of the stacks according to the invention may be adapted, in particular in order to be compatible with any dimensions of pallets and of means of transport. Furthermore, the invention was described on the basis of examples using rolls as insulation products. As a variant, as mentioned previously, the invention is also applicable to other insulation products of elongated shape, such as batches of boards that are preassembled, having a substantially parallelepipedal shape. Furthermore, the invention may be implemented with materials of the first, second and third films that are different from those described above.

The invention claimed is:

1. A module comprising compressible insulation products, each of the insulation products having a longitudinal axis, a peripheral surface, and first and second ends that are perpendicular to the peripheral surface, the module comprising:

a single row of the insulation products positioned next to one another, successively along a first direction perpendicular to the longitudinal axes of the insulation products, the insulation products of the row having their longitudinal axes parallel to one another, a first film which wraps each of the insulation products of the single row in a compressed state of the insulation product by covering the peripheral surface of the insulation product, a second film which wraps the single row of the insulation products by covering some of the peripheral surface of the insulation products of the row, and a third film which wraps only the single row of the insulation products by directly covering the first and second ends of each of the insulation products of the row and directly contacting the second film on two sides of the peripheral surface of the insulation products of the row, the third film forming a continuous wrap around, and covering an entirety of, the first and second ends and the two sides of the peripheral surface of each of the insulation products of the row.

2. The module as claimed in claim 1, wherein the second film and the third film form, around the single row of the insulation products, two sleeves having axes that are perpendicular to one another.

3. The module as claimed in claim 1, wherein the single row of the insulation products is completely covered by the combination of the second film and the third film.

4. The module as claimed in claim 1, wherein the second film wraps the single row of the insulation products in a compressed state of the insulation products against one another along the first direction.

5. The module as claimed in claim 1, wherein the third film wraps the single row of the insulation products in a compressed state of the insulation products along a second direction perpendicular to the longitudinal axes of the insulation products and to the first direction.

6. The module as claimed in claim 1, wherein, in the module, each of the insulation products has a square cross section with rounded corners.

7. The module as claimed in claim 1, wherein the second film and the third film are joined to one another by adhesive bonding or by welding.

8. A stack of modules comprising at least two of the modules as claimed in claim 1, which are superimposed along a second direction perpendicular to the longitudinal axes of the insulation products and to the first direction of each module.

9. A palletized assembly comprising:

a pallet, at least two of the stacks of modules as claimed in claim 8, which are superimposed on one another and on the pallet with the longitudinal axes of the insulation products perpendicular to the pallet, means for holding stacks on the pallet.

10. The module as claimed in claim 1, wherein the second film wraps the single row of the insulation products in a compressed state of the insulation products against one another along the first direction, the third film wraps the single row of the insulation products in a compressed state of the insulation products along a second direction perpendicular to the longitudinal axes of the insulation products and to the first direction, and compression applied in the first direction is greater than compression applied in the second direction.

11. A process for manufacturing a module having a single row of compressible insulation products, each of the insulation products having a longitudinal axis, a peripheral surface, and first and second ends that are perpendicular to the peripheral surface, the process comprising steps wherein:

wrapping each of the insulation products using a first film which covers the peripheral surface of the insulation product and which maintains the insulation product in a compressed state;

forming the single row of the insulation products by positioning several of the insulation products provided with the first film next to one another, successively along a first direction perpendicular to the longitudinal axes of the insulation products, the insulation products of the row having their longitudinal axes parallel to one another;

wrapping the single row of insulation products using a second film, which covers some of the peripheral surface of the insulation products of the row and which holds the insulation products of the row next to one another along the first direction; and wrapping the single row of the insulation products using a third film, wherein the third film wraps only the single row of the insulation products by directly covering the first and second ends of each of the insulation products of the row and directly contacting the second film on two sides of the peripheral surface of the insulation products of the row such that the third film forms a continuous wrap around, and covering an entirety of, the first and second ends and the two sides of the peripheral surface of each of the insulation products of the row.

12. The process as claimed in claim 11, wherein the single row of the insulation products is wrapped using second and third films by two successive encircling operations, so as to form two sleeves having axes perpendicular to one another.

13. The process as claimed in claim 11, wherein the second film wraps the single row of the insulation products in a compressed state of the insulation products against one another along the first direction, the third film wraps the single row of the insulation products in a compressed state of the insulation products along a second direction perpendicular to the longitudinal axes of the insulation products and to the first direction, and compression applied in the first direction is greater than compression applied in the second direction.

14. A process for manufacturing a palletized assembly comprising modules each having a single row of compressible insulation products, each of the insulation products having a longitudinal axis, a peripheral surface, and first and second ends that are perpendicular to the peripheral surface, the process comprising steps wherein:

wrapping each of the insulation products using a first film which covers the peripheral surface of the insulation product and which maintains the insulation product in a compressed state;

forming a single row of the insulation products of each module by positioning several of the insulation products provided with the first film next to one another, successively along a first direction perpendicular to the longitudinal axes of the insulation products, the insulation products of the row having their longitudinal axes parallel to one another;

forming each module having a single row of the insulation products by wrapping the single row of the insulation products using a second film, which covers some of the peripheral surface of the insulation products of the row and which holds the insulation products of the row next to one another along the first direction and by wrapping the single row of the insulation products using a third film, wherein the third film wraps only the single row of the insulation products by directly covering the first and second ends of each of the insulation products of the row and directly contacting the second film on two sides of the peripheral surface of the insulation products of the row such that the third film forms a continuous wrap around, and covering an entirety of, the first and second ends and the two sides of the peripheral surface of each of the insulation products of the row;

forming a stack of modules by superimposing at least two modules having a single row of the insulation products along a second direction perpendicular to the longitudinal axes of the insulation products and to the first direction of each module;

superimposing at least two stacks on one another and on a pallet with the longitudinal axes of the insulation products perpendicular to the pallet; and assembling the stacks and the pallet using holding means.

15. The process as claimed in claim 14, wherein the single row of the insulation products is wrapped using second and third films by two successive encircling operations, so as to form two sleeves having axes perpendicular to one another.

16. The process as claimed in claim 14, wherein the second film wraps the single row of the insulation products in a compressed state of the insulation products against one another along the first direction, the third film wraps the single row of the insulation products in a compressed state of the insulation products along a second direction perpendicular to the longitudinal axes of the insulation products and to the first direction, and compression applied in the first direction is greater than compression applied in the second direction.

* * * * *